United States Patent [19]

Dixon

[11] Patent Number: 4,920,667

[45] Date of Patent: May 1, 1990

[54] SNOW REMOVAL DEVICE

[76] Inventor: James W. Dixon, 856 E. Badger La., West Bend, Wis. 53095

[21] Appl. No.: 333,023

[22] Filed: Apr. 3, 1989

[51] Int. Cl.[5] ..... E01H 5/02

[52] U.S. Cl. ..... 37/285; 56/154; 56/239

[58] Field of Search ..... 37/285, 249, 254, 257, 37/258; 56/156, 157, 154, 239, 244, 249, 294, 295

[56] References Cited

U.S. PATENT DOCUMENTS

| | | | |
|---|---|---|---|
| 617,830 | 1/1899 | Herran | 37/285 |
| 2,768,453 | 10/1956 | Adams, Jr. | 37/285 X |
| 2,769,255 | 11/1956 | Mead | 37/257 |
| 3,021,620 | 2/1962 | Rosenthal | 37/254 |
| 3,913,247 | 10/1975 | Ruhl | 37/258 |
| 4,346,526 | 8/1982 | Mattson et al. | 37/259 |

FOREIGN PATENT DOCUMENTS

| | | | |
|---|---|---|---|
| 729860 | 3/1966 | Canada | 37/249 |
| 821411 | 8/1969 | Canada | 37/249 |
| 201456 | 11/1967 | U.S.S.R. | 37/257 |
| 1021401 | 6/1983 | U.S.S.R. | 56/239 |

*Primary Examiner*—Randolph A. Reese
*Assistant Examiner*—J. Russell McBee
*Attorney, Agent, or Firm*—Foley & Lardner

[57] ABSTRACT

A snow removal device including a frame, an auger mounted for rotary motion in said frame, a blade mounted in the frame in close proximity to the auger and a handle connected to the frame for pushing the auger through the snow. The handle is mounted on the frame to extend radially outwardly from the axle of the auger. The auger can have a single or double twist blade and can be a one-direction or two-direction type blade.

11 Claims, 1 Drawing Sheet

SNOW REMOVAL DEVICE

BACKGROUND OF THE INVENTION

1. Field of the Invention

This invention relates generally to devices for removal of snow from walkways and driveways and, more particularly to a manual type snow removal device for removing snow without lifting the snow or exerting much effort to remove the snow.

2. Description of the Prior Art

Removal of snow from residential and commercial walkways and driveways is a demanding task which must ordinarily be done in a minimum of time. Considerable effort is required or expended to accomplish the removal of snow and generally the work must be carried out in cold temperatures. Because of these factors, considerable physical exertion is required which often results in significant health hazard to individuals who are not used to physical exertion. To reduce this task many people purchase power driven equipment which often far exceeds the power required to remove the snow and, in many instances, people are hired to move the snow for the individual owner.

Ownership of power equipment does not necessarily eliminate the physical exertion to remove the snow. Handling of power driven equipment in snow removal operations in cold weather and on slick surfaces often requires as much effort as shoveling. This equipment also requires storage space and annual maintenance check ups in order to maintain the equipment in proper condition for continued use.

The wide variety of manual tools have been designed for snow removal. Obviously, the most common tool is the shovel which is used for both pushing and lifting snow. A variety of pushing and lifting devices have been designed over the years however, all these devices require considerable effort in order to accomplish removal of the snow.

SUMMARY OF THE INVENTION

The present invention relates to manual snow removal devices which employs the above objection by reducing the effort required to manipulate the device to a level which can be handled by the average person. The snow removal device of the present invention eliminates the necessity for lifting the snow as well as reducing the effort required to push the snow off of the driveway.

The snow removal device includes an auger, a blade, and a handle. The handle is disposed in a direction which applies pressure on the axle of the auger thereby requiring only the pushing of the roller through the snow while walking at a normal pace. The blade is positioned immediately behind the auger so that the snow that accumulates between the blade and the auger is immediately carried out to the right or left depending upon the direction of the auger blades. Since the snow removal device is in the form of a wheel, little or no effort is required in order to roll it over the sidewalk. The blade is disposed in close proximity to the rear of the auger so that little snow is accumulated in front of the blade, thus reducing the effort to push the blade along the sidewalk or driveway.

The handle may be arranged relative to a one way auger so it can be pivoted from one side to the other and thus does not require turning or lifting of the auger in order to retrace the steps in the opposite direction to complete the clearing of the sidewalk or driveway. The blade may be symmetrical with respect to the axis of the auger so that it can be used to function in the same manner in either direction of motion of the auger.

Accordingly, one of the principal features of the invention is the provision of a snow removal device which is simple to operate and easily moved through the snow with little effort.

A further feature of the invention is to provide a snow removal device which can be used to remove snow from irregular surfaces thus eliminating any jarring of the operator upon contact with hidden obstructions or irregularities.

Another feature of the invention is the provision of a snow removal device which is simple in its construction, requires little or no maintenance and is light in weight.

Other principal features and advantages of the invention will become apparent to those skilled in the art upon review of the following detailed description, claims and drawings.

DETAILED DESCRIPTION OF THE DRAWINGS

Figure 1:
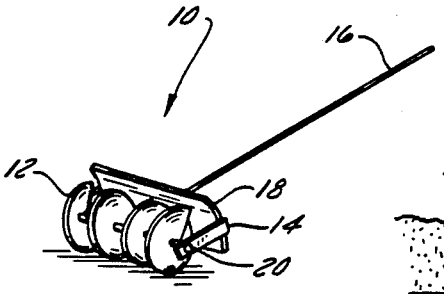
FIG. 1 is a perspective view of the snow removal device according to the invention having a two direction auger.

Although a number of embodiments of the invention are explained in detail, it is to be understood that the invention is not limited in its application to the details of construction and the arrangement of the components set forth in the following description or illustrated in the drawings. The invention is capable of other embodiments and of being practiced or carried out in various ways. Also, it is to be understood, that the phraseology and terminology used herein is for the purpose of description and should not be regarded as limiting.

DETAILED DESCRIPTION OF THE INVENTION

Figure 2:
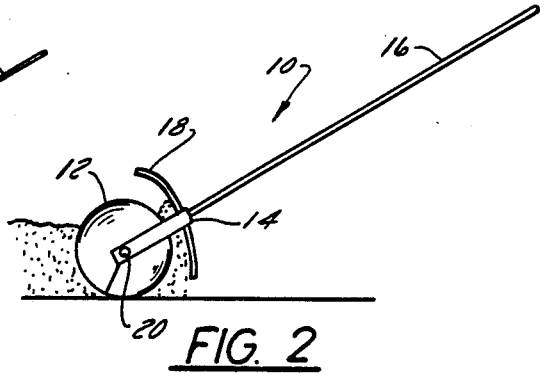
FIG. 2 is a side elevation view of the snow removal device.

Referring to FIGS. 1 and 2 of the drawings, the snow removal device 10 generally includes an auger 12, a frame 14, and a handle 16. A blade 18 is secured to the frame 14 in close proximity to auger 12. The device is operated by pushing on the handle 16 which applies a force to the axle 20 of the auger 12 through the frame 14 which causes the auger to roll on the surface of a driveway or sidewalk. Snow which accumulates between the auger 12 and the blade 18 is augered transversely outwardly from the blade. In the embodiment shown in FIGS. 1 and 2, a single twist, two direction auger is shown which discharges the snow outwardly from both sides of the blade 18.

One of the important features of the invention is the disposition of the handle 16 with respect to the axle 20 of the auger 12. As seen in FIG. 2, the handle extends radially outwardly from the axle forming a continuation of the frame 14 so that the pushing force is directed directly onto the axle to force the auger down into the snow. The handle 16 can be pivoted upwardly to increase the downward force on the axle if the auger is not penetrating the layer of snow. As the auger rotates along the driveway, the snow is accumulated in front of the blade 18 so that it is forced outwardly by the auger 12. Although the device has been described in connection with the removal of snow, it is within the contemplation of the invention to use the device for removal of granular, powdered or flowable materials.

The frame 14 generally includes a pair of side members 22 and a cross member 24. The blade 18 is mounted on the cross member 24 between the ends thereof. The handle 16 is secured to the member 24 intermediate the ends thereof.

Figure 3:
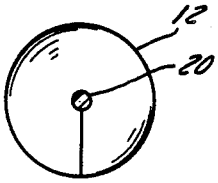
FIG. 3 is an end view of a single twist type auger.
Figure 4:
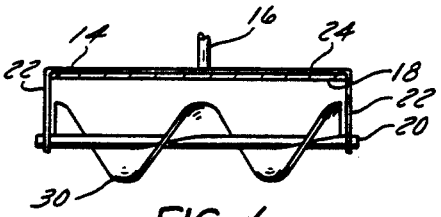
FIG. 4 is a front view of the device having a single twist auger.
Figure 5:
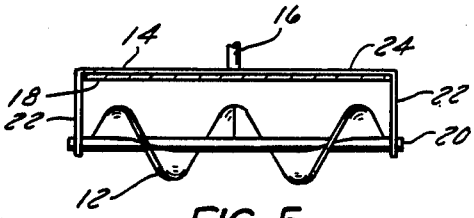
FIG. 5 is a front view of a two direction type auger.

The auger can take a number of shapes. As noted above, the auger in FIGS. 1 and 5, is a single twist, two direction type auger. FIG. 3 is an end view of the single twist auger 12. If it is desired to discharge the snow in one direction only, a single twist auger 30 as shown in FIG. 4 can be mounted in the frame 14. The snow will be discharged to the left in FIG. 4 when the auger is pushed in one direction. If the handle is turned to the opposite side of a single direction auger, the snow will also be discharged to the left.

Figure 6:
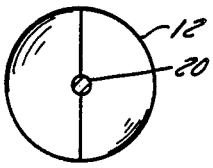
FIG. 6 is an end view of a double twist auger.
Figure 7:
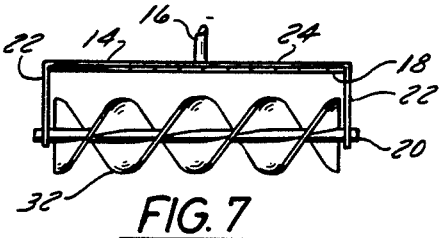
FIG. 7 is a front view of a device having a double twist auger.
Figure 8:
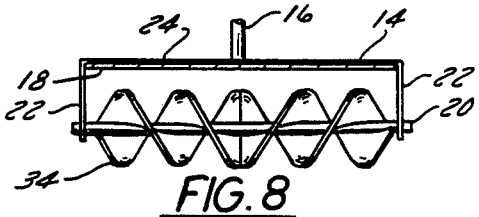
FIG. 8 is a front view of a device having a two direction, double twist type auger.

FIG. 6 is an end view of a double twist type auger that can be used to reduce the amount of snow which is pushed by each of the auger blades. As seen in FIG. 7, a double twist single direction type auger 32 is shown mounted on the frame 14. In FIG. 8, a double twist auger 34 is shown which discharges in two directions.

Thus, it should be apparent that there has been provided, in accordance with the invention, a snow removal device that fully satisfies the aims and advantages set forth above. While the invention has been described in conjunction with specific embodiments thereof, it is evident that many alternatives, modifications and variations will be apparent to those skilled in the art. Accordingly, it is intended to embrace all such alternatives, modifications and variations as fall within the spirit and broad scope of the appended claims.

The embodiments of the invention in which a exclusive property or priviledge is claimed are defined as follows:

1. A device for removing snow from a surface, said device comprising:

a frame;

an auger having an axle, said auger being mounted in said frame for rotary motion on said axle and said auger being in rolling engagement with the surface;

a handle secured to said frame; and a blade mounted on said frame in close proximity to said auger whereby snow accumulating in the front of said blade will be augered transversely outwardly from said blade by the rolling motion of said auger on said surface.

2. The device according to claim 1 wherein said auger has a single twist for discharging snow in one direction.

3. The device according to claim 1 wherein said auger has a single twist auger arranged to discharge the snow in two directions.

4. The device according to claim 1 wherein said auger has a double twist arranged to discharge the snow in a single direction.

5. The device according to claim 1 wherein said auger has two double twist augers for discharge of the snow outwardly in opposite directions.

6. The device according to claim 1 wherein said handle extends radially outward from said axle of said auger.

7. A device for removing various types of materials from a surface, said device comprising:

an auger having an axle and said auger being in rolling engagement with the surface, a blade mounted for pivotal movement on said axle, and a handle operatively connected to said blade for rolling said auger on the surface to discharge the material transversely from said blade.

8. The device according to claim 7 wherein said handle extends radially outward from said axle of said auger.

9. The device according to claim 8 wherein said auger discharges the material transversely outwardly from said blade.

10. The device according to claim 8 wherein said auger has two opposite augers for discharge of the material transversely outwardly from opposite sides of said blade.

11. The device according to claim 7 wherein said handle can be pivoted with respect to said axle to adjust the distance of said blade with respect to said surface.

* * * * *